US005680965A

United States Patent [19]

Beck

[11] Patent Number: 5,680,965

[45] Date of Patent: Oct. 28, 1997

[54] TAMPER EVIDENT CONTAINER CLOSURE

[76] Inventor: Matthew R. Beck, 8239 Archer Ave., Willow Springs, Ill. 60480

[21] Appl. No.: 593,673

[22] Filed: Jan. 29, 1996

[51] Int. Cl.[6] ..... B67B 5/00

[52] U.S. Cl. ..... 222/153.06; 222/525; 222/541.5; 222/559

[58] Field of Search ..... 222/521, 525, 222/559, 541.1, 541.5, 153.06

[56] References Cited

U.S. PATENT DOCUMENTS

| | | | |
|---|---|---|---|
| 2,998,902 | 9/1961 | Thomas et al. . | |
| 3,283,966 | 11/1966 | Miller | 222/521 X |
| 3,695,476 | 10/1972 | Ruekberg . | |
| 3,828,981 | 8/1974 | Linkletter . | |
| 4,126,240 | 11/1978 | Brach . | |
| 4,371,089 | 2/1983 | Barendregt . | |
| 4,402,415 | 9/1983 | Hopley . | |
| 4,408,700 | 10/1983 | Fillmore et al. | 222/153.06 |
| 4,434,904 | 3/1984 | D'Amico et al. . | |
| 4,458,821 | 7/1984 | Ostrowsky . | |
| 4,478,343 | 10/1984 | Ostrowsky . | |
| 4,494,663 | 1/1985 | Bertaud et al. . | |
| 4,540,100 | 9/1985 | Willis . | |
| 4,546,893 | 10/1985 | Stull . | |
| 4,562,931 | 1/1986 | Brach et al. . | |
| 4,709,823 | 12/1987 | Beck et al. . | |
| 4,746,035 | 5/1988 | Anderson et al. . | |
| 4,779,764 | 10/1988 | Debetencourt . | |
| 4,801,030 | 1/1989 | Barriac . | |
| 4,884,706 | 12/1989 | Julian . | |
| 4,919,285 | 4/1990 | Roof et al. . | |
| 4,923,073 | 5/1990 | Wilde . | |
| 5,005,720 | 4/1991 | Heilman . | |
| 5,009,323 | 4/1991 | Montgomery et al. . | |
| 5,038,951 | 8/1991 | Rizzardi . | |
| 5,085,333 | 2/1992 | Dutt et al. . | |
| 5,088,613 | 2/1992 | Dutt et al. . | |
| 5,104,008 | 4/1992 | Crisci . | |
| 5,111,967 | 5/1992 | Schreiber . | |
| 5,131,550 | 7/1992 | Thompson . | |
| 5,135,123 | 8/1992 | Nairn et al. . | |
| 5,158,192 | 10/1992 | Lataix . | |
| 5,197,619 | 3/1993 | Margaria . | |
| 5,199,605 | 4/1993 | Schneider . | |
| 5,284,277 | 2/1994 | Leuenberger . | |
| 5,310,097 | 5/1994 | Leuenberger . | |
| 5,325,999 | 7/1994 | Gueret . | |
| 5,328,063 | 7/1994 | Beck et al. . | |
| 5,377,870 | 1/1995 | Morel . | |
| 5,456,374 | 10/1995 | Beck . | |

*Primary Examiner*—Gregory L. Huson
*Attorney, Agent, or Firm*—Emrich & Dithmar

[57] ABSTRACT

A tamper evident closure construction is provided for use with a container of the type having a neck with a discharge orifice therein. The tamper evident closure construction includes a dispenser cap for controlling the dispensing of materials through the discharge orifice. The dispenser cap includes a base connected to the neck and a dispensing portion connected to the base. The tamper evident container closure construction also includes a container cap having a mounting portion adapted to be fastened directly to the neck of the container and a second dispensing portion connected by at least one tamper evident connection to the mounting portion. The at least one tamper evident connection is severable from the mounting portion to provide a visual indication of tampering. The second dispensing portion, when severed, is disposed for sliding movement with respect to the first dispensing portion to facilitate the dispensing of materials from the container. The mounting portion operates to secure and seal the base of the dispenser cap to the neck once assembled thereto.

20 Claims, 1 Drawing Sheet

TAMPER EVIDENT CONTAINER CLOSURE

BACKGROUND OF THE INVENTION

1. Field of the Invention

The present invention relates to container closures and, more particularly, to a tamper evident container closure construction of the type providing indication of previous opening and possible tampering with a container's contents.

2. Description of the Prior Art

In recent years there has been an emphasis on ensuring that the dispensing (neck) openings of containers are provided with tamper evident closures and, more particularly, closures that are resistant to opening and which, when opened, provide an indication of such opening. A known type of tamper evident closure construction includes multi-part cap closures, whereby an outer or upper portion of a dispenser cap, which encloses a container dispenser opening, is provided with tamper evident frangible or snap-fit connections. A base cap, which is usually unitary with the dispenser cap, is further provided that encloses the cylindrical neck of the container and incorporates a second tamper evident feature.

One such multi-part cap closure is shown in U.S. Pat. No. 5,104,008 to Crisci. The Crisci dispenser cap is a push-pull type dispenser cap consisting of an outer valve portion, an inner valve portion and a base cap portion formed unitary with the inner valve portion and enclosing the neck. The outer valve portion substantially encloses the inner valve portion and is provided with frangible elements which are broken when forcibly moving the outer valve portion upwardly relative to the inner valve portion. Once the frangible elements are broken, an integral ring connected thereby to the outer valve portion is severed providing a visual indication that the dispenser cap has been previously opened to permit the contents of the bottle to be used. The base cap portion includes a tear tab which functions to provide a second indication of tampering when an attempt has been made to remove the dispenser cap so as to refill or change the contents of the container. Any attempt to remove the dispenser cap, tamper with the container contents and then re-attach the dispenser cap, would be readily detected. While the tamper evident feature of the base portion is useful, the unitary construction of the base portion and the inner dispensing portion does not adequately seal and secure the dispenser to the neck of the container. An improved closure is therefore sought which provides for more secure enclosure of the container neck and which is of simple construction.

SUMMARY OF THE INVENTION

It is a general object of the present invention to provide an improved tamper evident closure construction for use with a container which is economical and easy to manufacture.

It is another object of the present invention to provide a dispenser cap at least a portion of which is snap-fitted to a container cap, the latter having at least a first tamper evident element and being of the type securely sealing the dispenser cap to the mouth (opening) of the neck. The container cap may further be provided with a second tamper evident element. The first tamper evident element indicates prior access to the dispensing portion of a dispenser cap connected to a container's neck, while the other tamper evident element indicates possible tampering with the container's contents by way of removal of the dispenser cap from the neck.

It is yet another object of the present invention to provide a tamper evident closure construction wherein the dispenser cap is secured to the container neck, such that removal of the dispenser cap from the neck can only be accomplished by first removing the container cap as well as the tamper evident element associated therewith.

It is yet a further object of the present invention to provide a tamper evident closure construction including a dispenser cap having a base which does not extend over the outside surface of the container neck but, instead, is snap-fitted into a container cap, which container cap includes a skirt that is threaded (or snap-fitted) into position over the outside surface of the container neck. The closure cap skirt integrally incorporates both a tamper evident feature as well as a means for attaching the container cap and dispenser cap to the container.

These and other features of the invention are attained by providing a tamper evident closure construction for use with a container of the type having a discharge orifice therein. The tamper evident closure construction includes a dispenser cap for controlling the dispensing of materials through the discharge orifice. The dispenser cap, in turn, includes a base connected to the neck and a dispensing portion connected to the base. The tamper evident container closure construction also includes a container cap having a mounting portion adapted to be fastened directly to the neck of the container and a second dispensing portion connected by at least one tamper evident connection to the mounting portion. The at least one tamper evident connection is severable from the mounting portion to provide a visual indication of tampering. The second dispensing portion, when severed, is disposed for sliding movement with respect to the first dispensing portion to facilitate the dispensing of materials from the container. The mounting portion operates to secure and seal the base of the dispenser cap to the neck once assembled thereto.

The container cap provides an indication of tampering, in accordance with a first embodiment, by way of a skirt threadedly engageable with the neck and a breakaway tamperband on the skirt engageable with the neck to resist unscrewing of the skirt from the neck. Unscrewing of the skirt from the neck severs the breakaway tamperband from the skirt and provides a visual indication of tampering.

Alternatively, in a second preferred embodiment of the tamper evident closure construction, indication of tampering is achieved by way of an abutment on the container cap which, during initial assembly, is disposable in snap-fit engagement with a groove on the neck of the container. Any attempted disengagement or prying off of the container closure cap from the neck of the container would cause deformation of the container closure cap and provide a visual indication of tampering.

Preferably, the at least one tamper evident connection consists of a plurality of frangible webs and the first and second dispensing portions are the inner and outer valve members, respectively, of a push-pull type dispenser.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
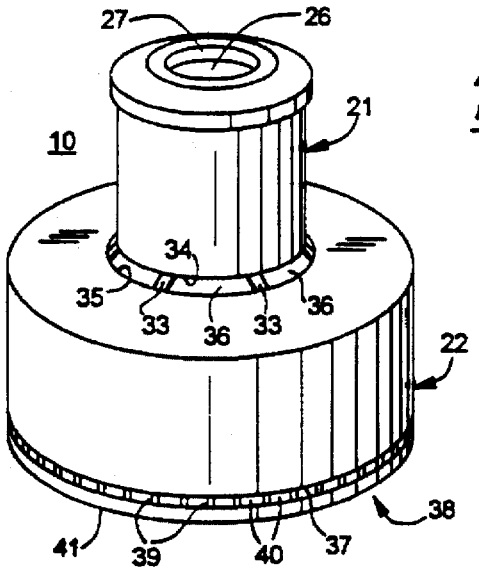
FIG. 1 is a perspective view of a tamper evident closure construction, constructed in accordance with and embodying the features of a first embodiment of the present invention, including a dispenser cap and a container cap.
Figure 3:
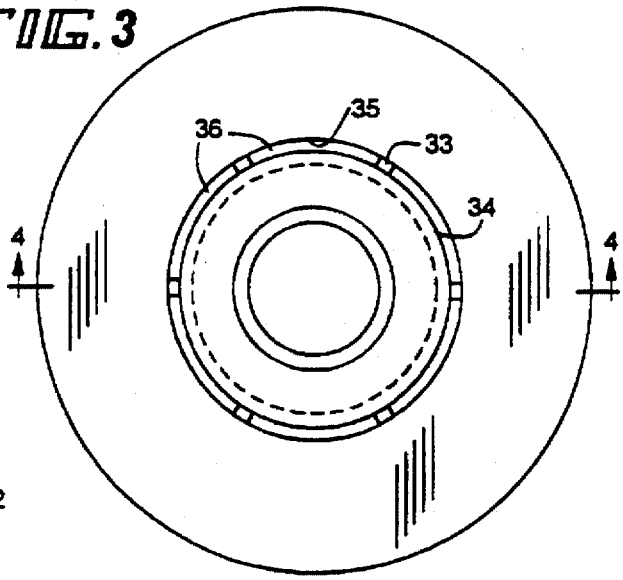
FIG. 3 is an enlarged top plan view of the tamper evident closure construction of FIG. 1.

Referring to FIGS. 1–4, there is illustrated a tamper evident closure construction, generally designated by the numeral 10, constructed in accordance with and embodying the features of a first embodiment of the present invention. FIG. 1 shows a perspective view of tamper evident closure construction 10 in its fully assembled form for use with a container 100 to be described below in connection with FIG. 4.

Figure 2:
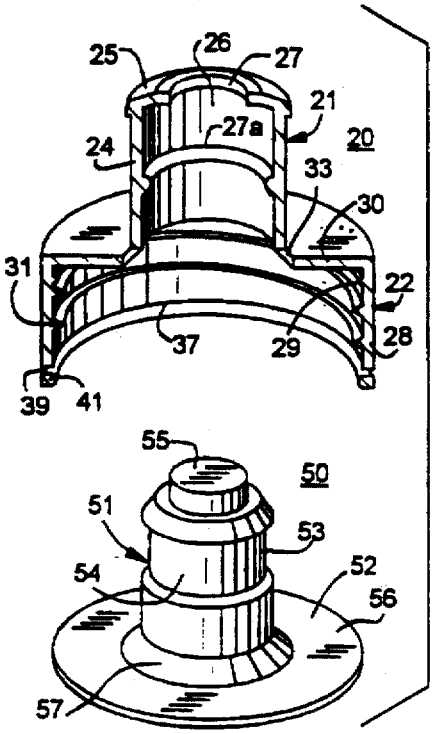
FIG. 2 is an exploded, perspective view of the tamper evident closure construction of FIG. 1, with the container cap shown in partial vertical section.

As is best shown in FIG. 2, the tamper evident closure construction 10 is of a two-part construction, including a container cap 20 and a dispenser cap 50, the latter comprising an upstanding dispenser cap portion 51 and a base portion 52. The two caps 20 and 50 cooperate to provide container 100 with a tamper evident dispenser cap, which not only allows the contents of container 100 to be dispensed in the manner to be described below, but also includes two telltale indications of possible tampering with the container contents.

Tamper evident container cap 20 includes a dispenser cap cover portion 21 and a neck mounting portion 22. Cover portion 21 includes a cylindrical side wall 24 and a circular end wall 25, which cooperate to define an inner cavity 26 which communicates with an opening 27 in end wall 25. Extending radially inwardly approximately midway along the length of the cylindrical wall 24 is a circumferential bead **27*a*. Mounting portion 22 is generally cylindrical in shape and includes a cylindrical skirt 28, of greater diameter than cylindrical wall 24 of cover portion 21, with an internal screw thread 29. A radially inwardly extending annular flange 30 is integral with the skirt 28 at its upper end and has an inner diameter slightly greater than the diameter of the cover portion cylindrical wall 24. A radially inwardly extending circumferential bead 31 is formed along an inner annular surface 32 of threaded skirt 28 between the flange 30 and the upper end of the thread 29. A plurality of circumferentially spaced frangible webs 33 extend between an open end 34 of cover portion cylindrical wall 24 and an inner edge 35 of annular flange 30, being integral with each for joining the dispenser cover portion 21 to the mounting portion 22 a slight distance above the flange 30. Between frangible webs 33 are slots 36**.

Joined to an open end 37 of skirt 28 is a tamperband 38, consisting of a series of circumferentially arranged frangible connectors 39 separated by small spaces 40, and a removable ring 41 coaxial with the skirt 28, the connectors 39 extending axially from the skirt 28 to the ring 41 and being integral with each.

The dispenser cap 50, comprised of the upstanding dispenser cap portion 51 and the base portion 52, is the inner valve member of a push-pull dispenser cap, with the severable dispenser cover portion 21 of container cap 20 corresponding to the outer valve member of the push-pull dispenser cap. The inner and outer valve members of the push-pull cap are movable axially between open and closed conditions, the range of motion relative to one another being limited by the cooperation of circumferential bead **27*a* formed on the inside surface of cylindrical wall 24 of dispenser cover portion 21 within an annular recess 53 provided on the outside surface of a circular wall 54 of upstanding dispenser cap portion 51. Although not shown, the upper end 55 of circular wall 54 includes one or more openings which allow the contents of the container 100 to flow through the upstanding portion 51 out through the opening 27 of dispenser cap cover portion 21**.

Push-pull dispensing caps are well known and will not be described further, except to explain the unique construction of the base portion 52 which has been dimensioned to be snap-fitted into engagement with the mounting portion 22 of container cap 20 by the cooperation of flange 30 and bead 31. More specifically, base 52 consists of a flat annular wall 56 integral with an inclined annular wall 57 of approximately equal thickness. An annular wedge 58 depends from annular wall 56. An outer edge surface 59 of annular wall 56 is partially rounded and the wall 56 is dimensioned to snap past the bead 31 into snap-fit engagement with mounting portion 22 between the flange 30 and the bead 31. The annular wall 56 is dimensioned to fit beneath the annular flange 30, with the inclined wall 57 disposed beneath the frangible webs 33 and slots 36 (see FIG. 4).

Figure 4:
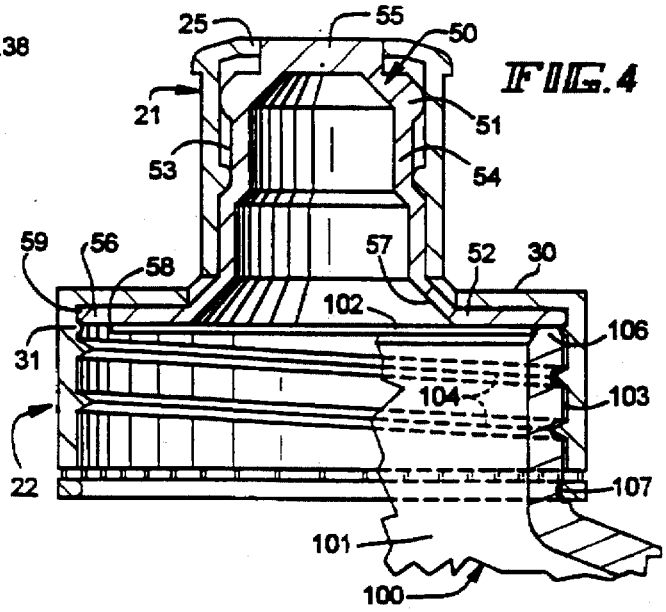
FIG. 4 is a vertical sectional view of the closure construction of FIG. 1, taken generally along line 4—4 in FIG. 3, and showing in fragmentary vertical section the threaded neck of a container to which the closure construction is assembled.

The tamper evident closure construction 10 shown in FIGS. 1–4 is intended to be used with container 100, one construction of which is shown in FIG. 4 in accordance with the first embodiment of the present invention. Container 100 could be any container having a neck 101 defining a discharge orifice 102. Neck 101 is defined by a cylindrical wall 103 with external threads 104 which are configured for threaded engagement with threaded skirt 28 of container cap mounting portion 22. The distal end of neck 101 defines a lip 106 which is dimensioned so as to be cooperatively received in a wedge fit between annular wedge 58 and bead 31. Annular wedge 58 is sloped to allow lip 106 to slide into position against the inner surface of wall 56 when the tamper evident closure construction 10 is screwed on neck 101. This assures a secure fit and a tight seal between the container 100 and the dispenser cap 50. Also, when the push-pull dispenser cap valve members 21, 50 are in the closed position, as shown in FIG. 4, the container's contents are protected against ambient conditions.

Adjacent to the bottom of neck 101, an annular groove 107 is formed in its outer surface dimensioned to matably receive the removable ring 41 of tamperband 38 in snap-fitted engagement during assembly of the tamper evident closure construction 10 to container 100.

Figure 5:
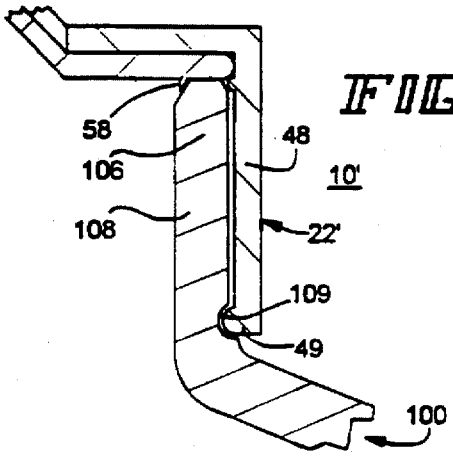
FIG. 5 is a further enlarged, fragmentary, vertical sectional view of a tamper evident closure construction according to a second embodiment of the present invention, shown assembled to a non-threaded container neck.

In an alternative embodiment, shown in FIG. 5, a mounting portion 22', having a cylindrical non-threaded skirt 48, is substituted for the threaded skirt 28 of mounting portion 22 of container cap 20, for engagement with a non-threaded neck 108 of a container 100'. Non-threaded neck 108 is provided adjacent to the bottom thereof with an annular groove 109 in its outer surface, dimensioned to matingly receive in snap-fit engagement a curved, circumferential abutment 49, provided at a bottom end of non-threaded neck 108, during assembly of the tamper evident closure construction 10' to neck 108. With the exception of structural differences described above in connection with the mounting portions 22 and 22' of the respective first and second embodiments, the two embodiments of the present invention are otherwise identical.

Tamper evident container cap 20, as well as dispenser cap 50, may be constructed from plastic or like material and injection molded into the shape generally shown in the drawings, so that the container cap 20 is of unitary, one-piece construction.

The assembly of tamper evident closure construction 10, of the first embodiment of the present invention, to container 100 will now be described in greater detail. Initially, dispenser cap 50 is assembled with the container cap 20 by snapping the base portion 52 of dispenser cap 50 into engagement with mounting portion 22, as explained above, and disposing, in snap fit engagement, the dispenser cap cover portion 21 (outer valve member) over the upstanding dispenser cap portion 51 (inner valve member), as is best shown in FIG. 4.

Once the dispenser cap 50 is snap-fitted inside the unitary, one-piece, container cap 20, the whole structure is assembled to the neck 101 of container 100 in the manner shown in FIG. 4. Initially, the container cap 20 is threaded onto the externally threaded cylindrical wall 103 of neck 101 until the removable ring 41, which is integral with the mounting portion 22, is brought into snap-fit engagement with the annular groove 107. As this occurs, lip 106 of neck 101 will be caused to become securely engaged below wall 56 and between annular wedge 58 and the bead 31. The tight-fit arrangement of dispenser cap 50 and container cap 20 to container neck 101 results in a secure and leak-proof container construction incorporating two very different tamper evident features.

The first tamper evident feature is provided by a fracture line defined by frangible webs 33. Upon application of an upward or rotational force to the dispenser cap cover portion 21, as by manually grasping the same and pulling the cover portion 21 upwardly away from the mounting portion 22 or twisting it, the cover portion 21 will become separated from the mounting portion 22 as the frangible webs 33 are broken. Once the cover portion 21 is severed, a visible indication of possible tampering is provided. When severed, the cover portion 21 (outer valve member) is manually accessible for sliding movement relative to the dispenser cap portion 51 (inner valve member) for normal operation as a push-pull dispenser. Once opened, the contents of container 100 can be dispensed therethrough. However, because the base portion of dispenser cap 50 remains engaged between mounting portion 22 and lip 106 of neck 101, even after dispenser cap cover portion 21 is broken off, refilling the container may not be possible. A broken cover portion 21 serves as an indication that the container 100 may not be entirely full and/or that the contents may have been tampered with.

Any effort to unscrew the mounting portion 22, so as to remove the dispenser cap 50 entirely, will cause frangible connectors 39 of tamperband 38 to break, causing removable ring 41 to become separated from cylindrical threaded skirt 28. The separated ring 41 provides the second tamper evident feature of tampering. When the removable ring 41 is separated from the skirt 28 and the mounting portion 22 unscrewed so as to be removed from the neck 101, dispenser cap 50 which is snap-fitted onto the cylindrical threaded skirt 28, will ultimately also become disengaged from the neck 101. In this way, the contents of the container are accessible and can be tampered with. Thereafter, the mounting portion 22 and dispenser cap 50 can be screwed back onto the neck 101 for reuse with container 100.

The absence or, alternatively, the detachment of removable ring 41 from mounting portion 22 serves as an indication of possible tampering with the container's contents. This is true whether or not the dispenser cap cover portion 21 is affixed to the mounting portion 22. Thus, if the removable ring 41 appears loose, or is missing, a purchaser of the container 100 will be forewarned that its contents may have been tampered with. Similarly, if frangible webs 33 are broken, a purchaser will quickly recognize that some of the container's contents already may have been dispensed or previously tampered with.

Alternatively, in the second preferred embodiment, shown in FIG. 5, tamper evident closure construction 10' is adapted for snap-fit engagement with the non-threaded neck 108 of the container 100'. Assembly of dispenser cap 50 within inner cavity 26 of dispenser cap cover portion 21, as well as within mounting portion 22', which mounting portion 22', is provided with a non-threaded cylindrical non-threaded skirt 48, is substantially as explained previously in connection with the description of mounting portion 22 of the first preferred embodiment. Tamper evident closure construction 10' is applied to container 100' simply by pressing it down to a position where curved abutment 49 snaps into the annular groove 109 on the neck 108. As in the first embodiment, a secure and tight fit engagement among the container 100' and the tamper evident closure construction 10' is assured by the cooperation of annular wedge 58, lip 106, and cylindrical non-threaded skirt 48 of mounting portion 22'. Any attempted disengagement, or prying off, of mounting portion 22' from neck 108, would cause deformation of mounting portion 22' providing an instant visual indication of tampering.

The second preferred embodiment differs from the first to the extent that the second tamper evident feature of the second embodiment is intended for use with containers whose contents are not intended to be replenished or changed. By contrast, the second tamper evident feature of the first preferred embodiment is intended to be used with containers, such as water bottles and the like, whose contents a purchaser would expect to replenish or change.

In both preferred embodiments, the first tamper evident feature, provided by frangible webs 33 which integrally join the dispenser cap cover portion 21 to the mounting portion 22 (22'), allows access to the contents of a container when the cover portion 21 is broken off, while leaving intact a second tamper evident feature, namely that provided by tamperband 38 (or by abutment 49), which provides an alternate indication of tampering, such as when an attempt has been made to remove the mounting portion 22 (22') so as to refill or change the contents of the container 100 (100').

It is envisioned that, while the second embodiment of FIG. 5 has been described as having a non-threaded container neck construction, a threaded neck construction—all else the same—can be substituted therefor without affecting the tamper evident nature of mounting portion 22' as described hereinabove.

From the foregoing, it can be seen that there has been provided an improved tamper evident container closure construction of the type provided with a push-pull type dispenser cap, which is economical, easy to manufacture, easily engageable with an appropriately sized neck of a container, and which provides two different telltale indications of tampering of a container's contents.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A tamper evident closure construction for use with a container of the type having a neck with a discharge orifice therein, comprising:

a dispenser cap for controlling the dispensing of materials through the discharge orifice, including a base adapted to be connected to the neck of the container and a first dispensing portion connected to said base; and a container cap including a mounting portion adapted to be fastened directly to the neck of the container and a second dispensing portion connected by at least one tamper evident connection to said mounting portion, wherein said at least one tamper evident connection is severable from said mounting portion to provide a visual indication of tampering and wherein said second dispensing portion when severed is disposed for sliding movement with respect to said first dispensing portion to facilitate the dispensing of materials from the container.

2. The tamper evident closure construction of claim 1, wherein said at least one tamper evident connection includes a plurality of frangible webs.

3. The tamper evident closure construction of claim 1, wherein said first and second dispensing portions are inner and outer valve members, respectively, of a push-pull type dispenser.

4. The tamper evident closure construction of claim 1, wherein said mounting portion includes a cylindrical skirt, an annular flange extending radially inwardly from said skirt, and a bead spaced axially from said flange and extending radially inwardly from said skirt, the bead and the flange of said mounting portion being dimensioned so as to receive the base of said dispenser cap and to secure and seal said base to the neck of the container.

5. The tamper evident closure construction of claim 4, wherein said cylindrical skirt has an inner annular surface which cooperates with an annular wedge extending from a bottom surface of the base of said dispenser cap to engage an uppermost lip on the neck of the container.

6. The tamper evident closure construction of claim 5, wherein said at least one tamper evident connection consists of a plurality of frangible webs.

7. The tamper evident closure construction of claim 5, wherein said first and second dispensing portions are inner and outer valve members, respectively, of a push-pull type dispenser.

8. The tamper evident closure construction of claim 4, wherein said mounting portion of said container cap is threadedly engageable with the neck and includes a breakaway tamperband engageable with the neck to resist unscrewing of the mounting portion from the neck, whereby unscrewing of said mounting portion from the neck severs said tamperband from said skirt to provide a visual indication of tampering.

9. The tamper evident closure construction of claim 8, wherein said at least one tamper evident connection consists of a plurality of frangible webs.

10. The tamper evident closure construction of claim 8, wherein said first and second dispensing portions are inner and outer valve members, respectively, of a push-pull type dispenser.

11. The tamper evident closure construction of claim 4, wherein the neck of the container has an annular groove and said mounting portion includes an abutment disposable in snap-fit engagement in the annular groove such that any attempted disengagement causes deformation of the mounting portion of said container cap to provide a visual indication of tampering.

12. The tamper evident closure construction of claim 11, wherein said at least one tamper evident connection consists of a plurality of frangible webs.

13. The tamper evident closure construction of claim 11, wherein said first and second dispensing portions are inner and outer valve members, respectively, of a push-pull type dispenser.

14. The tamper evident closure construction of claim 1, wherein said mounting portion is threadedly engageable with the neck and includes a breakaway tamperband engageable with the neck to resist unscrewing of said mounting portions from the neck, whereby unscrewing of said mounting portions from the neck severs said tamperband to provide a visual indication of tampering.

15. The tamper evident closure construction of claim 14, wherein said at least one tamper evident connection consists of a plurality of frangible webs.

16. The tamper evident closure construction of claim 15, wherein said first and second dispensing portions are inner and outer valve members, respectively, of a push-pull type dispenser.

17. The tamper evident closure construction of claim 14, wherein said first and second dispensing portions are inner and outer valve members, respectively, of a push-pull type dispenser.

18. The tamper evident closure construction of claim 1, wherein the neck of the container has an annular groove and the mounting portion of said container cap includes an abutment disposable in snap-fit engagement in the annular groove such that any attempted disengagement causes deformation of the mounting portion to provide a visual indication of tampering.

19. The tamper evident closure construction of claim 18, wherein said at least one tamper evident connection consists of a plurality of frangible webs.

20. The tamper evident closure construction of claim 18, wherein said first and second dispensing portions are inner and outer valve members, respectively, of a push-pull type dispenser.

* * * * *